United States Patent [19]

Blake

[11] Patent Number: 4,718,187

[45] Date of Patent: Jan. 12, 1988

[54] TRIGGER MEANS FOR A WEAPON CONTROL SYSTEM

[75] Inventor: Frank W. Blake, Annandale, Va.

[73] Assignee: Electronic Warfare Associates, Inc., Vienna, Va.

[21] Appl. No.: 914,310

[22] Filed: Oct. 2, 1986

[51] Int. Cl.[4] ..... F41C 19/12

[52] U.S. Cl. ..... 42/84; 89/136

[58] Field of Search ..... 42/84; 89/28.05, 28.1, 89/135, 136

[56] References Cited

U.S. PATENT DOCUMENTS

| | | | |
|---|---|---|---|
| 4,205,589 | 6/1980 | Engler et al. | 42/84 X |
| 4,256,013 | 3/1981 | Quitadama | 42/84 X |
| 4,329,803 | 5/1982 | Johnson et al. | 42/84 |

*Primary Examiner*—Ted L. Parr

*Attorney, Agent, or Firm*—Roland H. Shubert

[57] ABSTRACT

A rifle or similar weapon having a mechanical trigger is provided with a mechanism to discharge it by remote command without interfering with the normal trigger action of the weapon. The weapon operator remains in control of his weapon and is able to discharge it at will. A push-type solenoid is arranged to move the trigger in response to an electrical fire command signal from a source external to the weapon and firing circuit is provided to accept the command signal and activate the solenoid. The firing circuit is arranged to prevent discharge of the weapon by external signal except when it is in an aimed, fire-ready position as signaled by the weapon operator.

14 Claims, 7 Drawing Figures

TRIGGER MEANS FOR A WEAPON CONTROL SYSTEM

BACKGROUND OF THE INVENTION

This invention relates generally to triggering mechanisms allowing the synchronized firing of multiple weapons and to systems for their use.

More specifically, this invention relates to a mechanism for electronically triggering a firearm without interfering with its normal mode of trigger operation.

The taking of hostages during the commission of a crime or in the course of terrorist activities has become, increasingly common. Concern for hostage safety has ordinarily precluded the use of lethal force especialy when more than one kidnapper or terrorist was involved. It has long been recognized that, to successfully apply lethal force, it is necessary to kill a single terrorist instantly so as to prevent any retaliatory reaction and, in the case of multiple terrorists, to kill all simultaneously. Precise timing and effective communications become the most critical factors to achieve this result since failure to kill or incapacitate all terrorists at the same instant leaves the hostages vulnerable to injury or death.

It has been proposed in the prior art to provide a system including specially modified weapons, a central control unit, and communications linkage there between a permit the simultaneous firing of a plurality of weapons, by command from a central control unit, at the instant when a set of pre-determined conditions have been satisfied. One such system is disclosed in the Engler et al patent, U.S. Pat. No. 4,205,589. The system of Engler et al includes a plurality of weapons, typically rifles, each of which is equipped with a radio transmitter and receiver and with an electronically actuated trigger mechanism. The rifles are arranged so that depression of the trigger, as when a clear shot on a designated target is available, does not fire the weapon but instead causes a radio signal to be transmitted to the central control unit. A "fire" signal is generated by the central control unit at the time a group of pre-determined conditions is met. That signal is transmitted by radio to the individual weapons causing all weapons having depressed triggers to fire simultaneously. Because each of the weapons are modified to incorporate an electrical sear release replacing the original, trigger-operated mechanical sear release, none of the weapons can be mechanically fired by its operator.

Another such weapons control system is described in U.S. Pat. No. 4,256,013 to Quitadama. Patentee provides a plurality of rifles connected by means of electrical cables to a central control unit. Each rifle is arranged so that depression of the trigger will close a switch situated behind the trigger and transmit a fire-ready signal through the electrical cable to the control unit. The control unit is arranged so that it will transmit a "fire" signal to each rifle at the time all are in a fire-ready mode as represented by trigger depression.

In practice, it has been found that weapons control systems of the type above described have a number of drawbacks and disadvantages which severely limit their application and use. Because of the uncertainties and often rapid changing circumstances of typical hostage-takaing events, any central control system which interferes with or overrides the normal functioning of a weapon is undesirable or unacceptable. The system of Engler et al, for example, places total control of weapons firing with the master control unit. That unit is programmed to cause the simultaneous firing of multiple weapons upon satisfaction of certain criteria input into the control unit. A change of criteria occasioned, for example, by a change in circumstances requires re-programming; a step that introduces a finite delay in reaction by the system. Further, the electronic trigger used to fire the weapons of the Engler et al systemis powered by the discharge of a capacitor. The weapon cannot again be fired until the capacitor is re-charged; a process taking some eight to ten seconds to complete.

Quitadama does make provision for the conversion of his rifles to a manual firing mode. This is done by the rifleman manually moving a lever and cam into that position which causes firing of the weapon by the control unit. The conversion of a single weapon to the manual firing mode removes that weapon, and all other weapons in the system as well, from control of the central unit. Neither of the prior art systems described above allow for optional discharge of any or all the weapons controlled by the central control unit.

As may be appreciated, a weapons control system which provides for the firing of a single weapon or for the simultaneous firing of multiple weapons without interfering with the normal functioning of those weapons provides operational flexibility unobtainable with the systems known in the prior art.

SUMMARY OF THE INVENTION

A system is provided for the firing of one or more weapons, typically rifles, upon command from a central control unit remote from the weapons. The system is arranged so that the rifleman, or weapons operator, may discharge his weapon at any time independent of the central control unit so that maximum response flexibility to rapidly changing circumstances is assured.

Hence, it is an object of this invention to provide a means for firing a weapon by remote command without interfering with the normal operation of the weapon.

It is another object of this invention to provide a weapons control system capable of simultaneously firing a plurality of individually aimed weapons without interfering with the normal operation of any of the weapons.

It is yet another object of this invention to provide firing means for a weapon having an electrically operated, mechanical trigger arranged to discharge the weapon without interfering with the normal operation of the trigger.

Yet another object of this invention is to allow immediate second shot capability to a weapons control system by providing for shared control over the firing of each weapon between a central control unit and the weapon operator.

BRIEF DESCRIPTION OF THE DRAWING

Certain preferred embodiments of the invention are illustrated in the drawing in which.

DESCRIPTION AND DISCUSSION OF THE INVENTION

Figure 1:
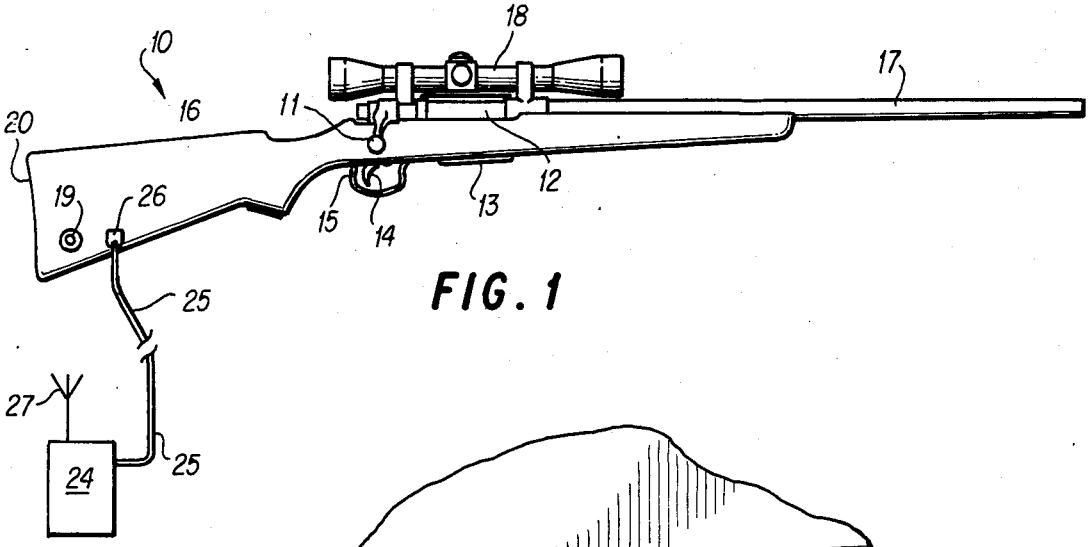
FIG. 1 is a pictorial view of a rifle having the firing means of this invention incorporated therewith.

The invention will be described by reference to the drawing in which like reference numerals refer to the same elements in each of the Figures making up the drawing.

Referring first to FIG. 1, there is illustrated a rifle shown generally at 10 which has been modified in accordance with this invention. Rifle 10 is shown as being a bolt action type having a hand operated bolt 11 for ejecting a spent cartridge from the chamber within receiver 12 and feeding a fresh cartridge into the chamber from magazine 13. The rifle is equipped with a mechanical trigger 14 protected by trigger guard 15. Rifle 10, rather than being bolt action, may be of other types having mechanical triggers including, for example, gas-operated, semi-automatic weapons such as the AR-15 or M-16.

Rifle 10 includes a stock 16 which provides a mounting for receiver 12 with attached barrel 17. The rifle is preferably equipped with a telescope sight 18 mounted on receiver 12. In a preferred embodiment of this invention, a switch 19 is mounted on the lower side of stock 16 near the butt 20 thereof. That placement of the switch is particularly advantageous when the front stock or barrel of rifle 10 is supported either on a bipod or on sand bags. When either a bipod or sandbags are used, the shooter's left arm is curled under the rifle and the stock is grasped at a location near the butt allowing the shooter to depress switch 19 with his left thumb. In other instances, particularly when the rifle is held and aimed without support, the switch 19 is more desirable located beneath the barrel on the forestock at a point where it is convenient for the shooter to reach and depress the switch button. Also, switch 19 may be attached to a cable and provided with detachable mounting means, such as a Velcro strap, allowing placement of the switch at various locations on the rifle.

Switch 19 is of double section type, each section having two terminals, and arranged so that one section is normally open and the other section is normally closed. For use in this invention, one section of switch 19 is arranged so that it is normally open, thus breaking a circuit, and is in the closed position only when the switch button is depressed and is held in the depressed position. Depression of switch 19 causes a signal to be transmitted to a central control unit indicating that the weapon is on target and is in a fire-ready position. Switch 19 performs another function as well. It is arranged within the firing circuit in a manner, to be described in detail in relation to FIG. 7, such that the weapon cannot be fired by external command except during those times that switch 19 is depressed. This feature also adds another safety feature to the system in that it is impossible for any extraneous radio signal to activate the firing circuit except when the weapon is in a fire-ready position.

Figure 7:
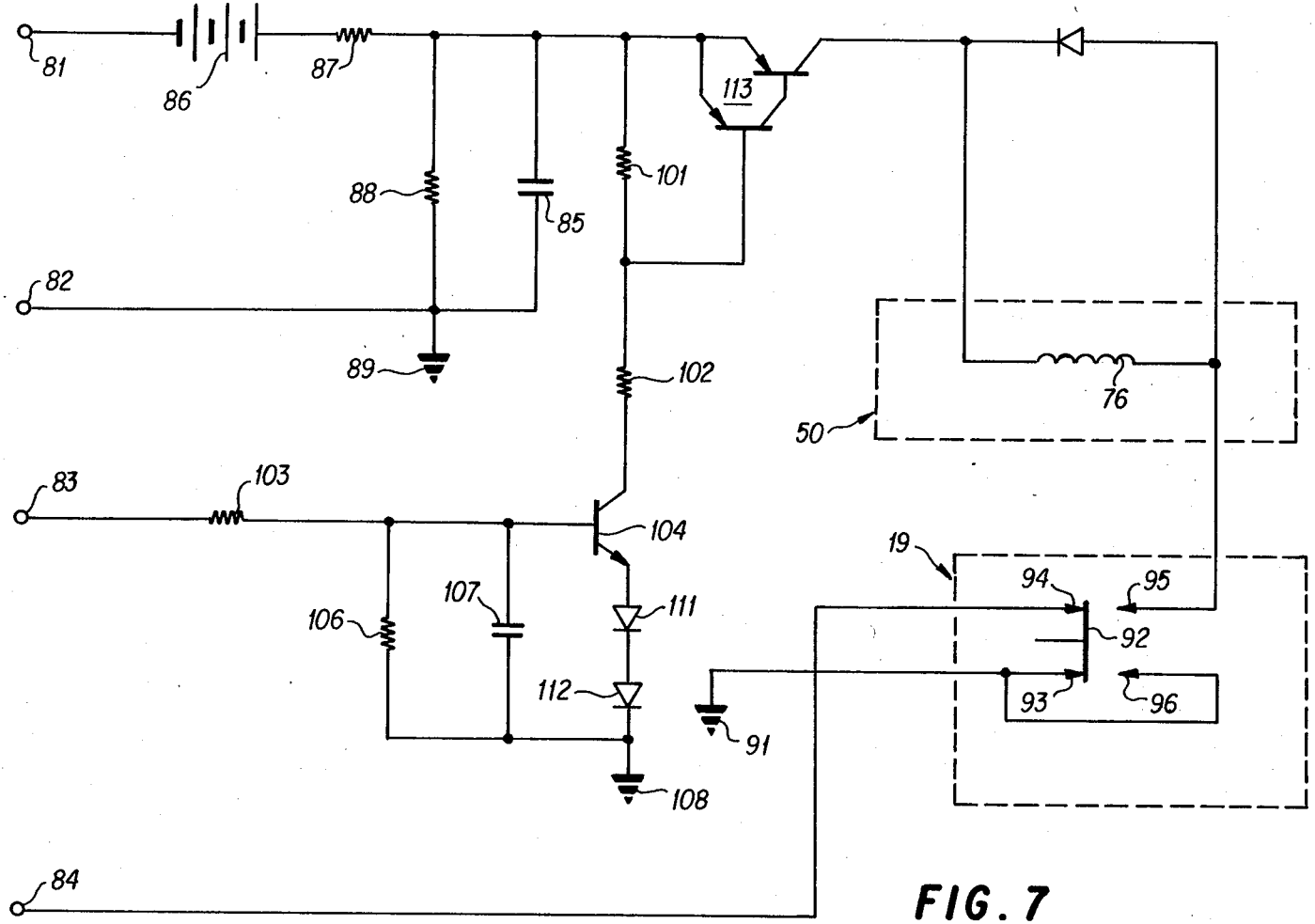
FIG. 7 is a schematic diagram of the energizing and firing circuit which activates the remote firing means.

The firing circuit, illustrated in FIG. 7, is incorporated into rifle 10 preferably within stock 16 near the butt thereof.

There is also provided a weapon control unit 24 which is connected to the firing circuit by means of cable 25 through detachable connector plug 26. Plug 26 may be located at any convenient spot on the stock and serves also to activate the firing circuit upon connection and to deactivate the circuit upon disconnection. Cable 25 is of sufficient length to allow placement of the weapon control unit 24 at a location which does not interfere with the normal movements of the weapon operator.

Weapon control unit 24 comprises a radio receiver and transmitter capable of receiving coded signals from a command unit (not shown) by way of antenna 27 and to transmit a signal indicating the position of switch 19 when that switch is in the depressed, or closed, position. Control unit 24 also includes decoding means arranged to recognize a fire command transmitted by the command unit and, in response to that command, cause an electrical signal to pass through cable 25 to the firing circuit.

Figure 2:
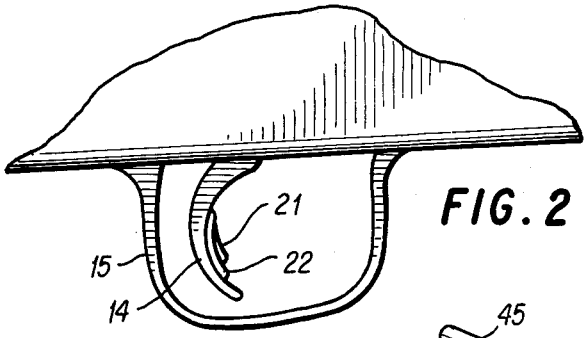
FIG. 2 illustrates an alternative means for indicating a fire-ready condition of the rifle of FIG. 1.

FIG. 2 illustrates another arrangement of the switch means which has advantage in certain instances. In this embodiment, a micro-switch having a movable button 21 and a base 22 in mounted on the front surface of trigger 14 at a location where the shooter's trigger finger naturally overlies the switch. The switch is arranged to function exactly like switch 19, one section being closed only when switch button 21 is depressed. It is important in this embodiment that the force required to depress switch button 21 be far less than the trigger pull required to discharge the weapon. Consequently, it is preferred that this switch arrangement be used only in weapons having a relatively heavy trigger pull, typically about 6 to 8 pounds, and not be used with weapons having a very light trigger pull. The force required to depress switch button 21 can be made quite small, as little as four ounces or even less.

Figure 3:
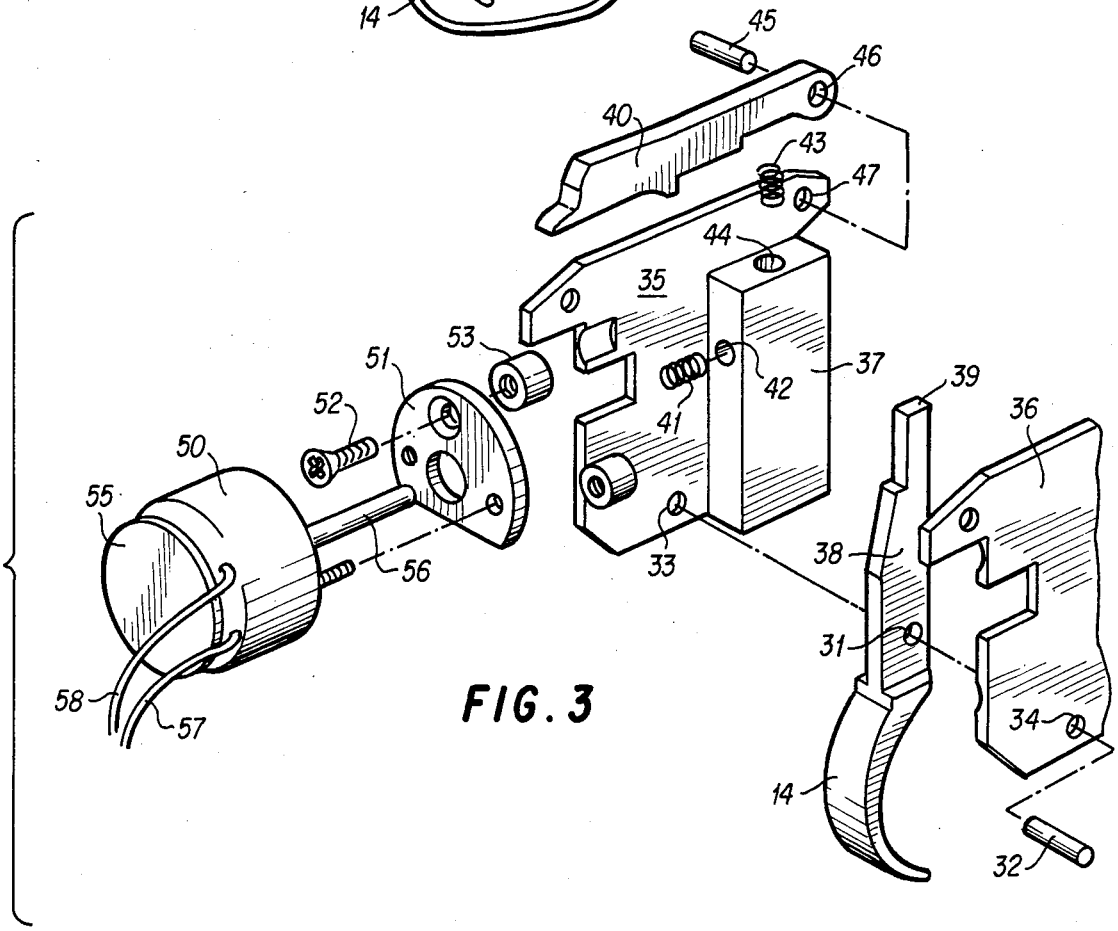
FIG. 3 is a disassembled view of the trigger mechanism and remote firing means of this invention.

Turning now to FIG. 3, there is shown a disassembled view of an exemplary trigger mechanism and remote firing means in acordance with the invention. Trigger 14 is provided with a bore 31 through which pin 32 is passed to form a pivot point and to allow the trigger to rotatably pivot backwardly through a small arc under pressure from a shooter's finger. The ends of pin 32 seat in hole 33 in the left trigger housing wall 35 and in hole 34 in the right trigger housing wall 36 respectively. Housing walls 35 and 36 are secured in a spaced apart parallel attitude by means of end block 37 which is positioned to the front of the trigger housing.

Trigger 14 is extended beyond pivot point 31 to form arm 38 having a latch face 39 which cooperates with sear release arm 40 to cause firing of the weapon in a manner to be described in greater detail later in connection with the description of FIGS. 4 and 5. In this particular embodiment, arm 38 extends generally vertically upward from the pivot point 31. Depending upon the weapon, the orientation of arm 38 in relation to pivot point 31 may differ from that shown. For example, when the firing means of this invention is used with a military weapon such as the AR-15 or M-16, arm 38 extends forward from the pivot point in a generally horizontal attitude.

Trigger spring 41 is seated in recess 42 formed in end block 37 and exerts a force on trigger arm 38 providing resistance to the backward movement, or pulling, of trigger 14. In a like manner, there is provided a second spring 43 which is seated in recess 44 formed in the top of end block 37. Spring 43 acts upon a bottom surface of release arm 40, as is more clearly shown in FIG. 4, to return it to a sear-engaging position after the weapon has been discharged and a fresh cartridge fed into the chamber. Release arm 40 is pivoted at its front end on a pin 45 which fits through bore 46 and is seated in hole 47 of the left housing wall 35 and in a corresponding and aligned hole (not shown) in the right housing wall.

A trigger arm motive means 50, preferably comprising a short stroke, push solenoid, is mounted at the back of trigger mechanism by means of mounting plate 51. Mounting screw 52 extends through plate 51 and seats in boss 53 which is attached as by brazing to the housing wall.

Solenoid 50 is preferably of the type having an auxiliary flux path 55. This arrangement provides an increase in force applied to solenoid plunger 56 as compared to conventional solenoid design when an electric current is applied to the coil. Lead wires 57 and 58 supply a burst of current to the coil of solenoid 50 when the weapon control system receives a fire command from an external source, typically a central control unit. This will be discussed in detail in relation to the firing circuit described in FIG. 7.

Figure 4:
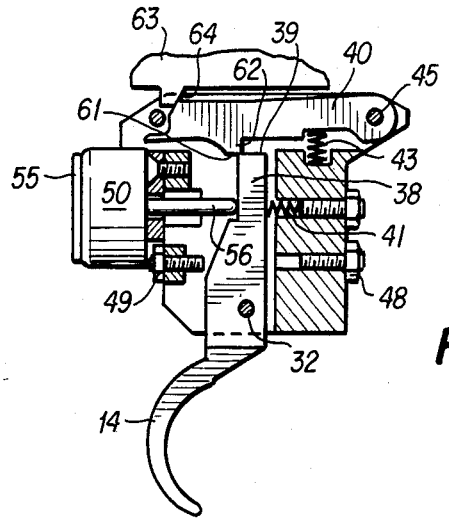
FIG. 4 is a partial sectional view of the trigger mechanism and remote firing means in a ready position.
Figure 5:
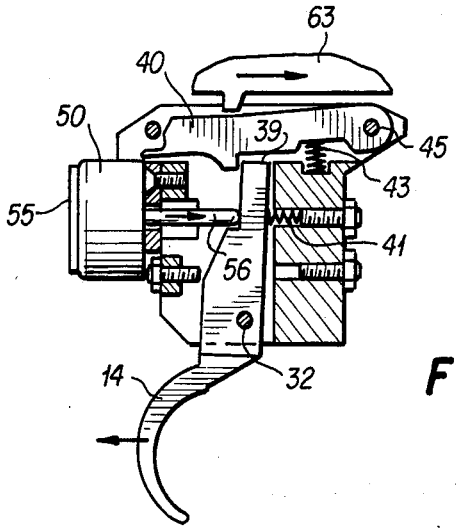
FIG. 5 is a partial sectional view of the trigger mechanism and remote firing means as the weapon fires.

Turning now to FIGS. 4 and 5, along with FIG. 3, there is illustrated the operation of the firing means and trigger mechanism of this invention. FIG. 4 shows the mechanism in a fire-ready state in which the face 61 of protrusion 62 on sear release arm 40 rests on latch face 39 of arm 38. Firing pin 63 is urged forward by spring means (not shown) and exerts a downward force on release arm 40 by way of beveled face 64 sufficient to overcome the upward force applied to sear arm 40 by spring 43. The end of solenoid plunger 56 is in resting contact with the back side of arm 38.

FIG. 5 shows the mechanism in the action of firing. Either a backward pull on trigger 14, in the direction shown by the arrow, or a forward push or thrust by solenoid plunger 56 upon arm 38 will release firing pin 63 and cause the weapon to fire. Trigger 14 may be operated independently of solenoid 50 to cause the weapon to fire and, of course, activation of solenoid 50 to push plunger 56 against arm 38 will independently cause the weapon to fire. Only a very short movement of solenoid plunger 56, typically about 0.020 mils maximum, is needed to move face 39 forward sufficiently to allow arm 40 to drop releasing firing pin 63. The distance through which face 39 of arm 38 is allowed to move is controlled by means of forward travel adjustment screw 48 and rearward travel adjustment screw 49.

Figure 6:
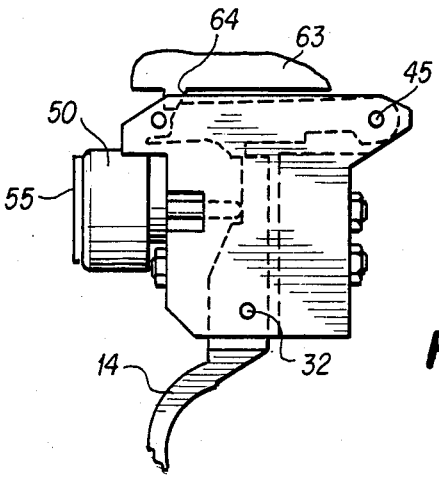
FIG. 6 is an assembled view of the trigger mechanism and remote firing means.

After firing, the weapon bolt is released and slid backwardly to eject the spent cartridge and to feed a fresh cartridge into the chamber. During this re-loading procedure firing pin 63 is slid backwardly to again engage release arm 40 through beveled face 64 as is best shown in FIG. 6. At that point, the weapon is again ready for my manual control through a pull of trigger 14. There is a delay, typically of some six to eight seconds, before the weapon can again be fired by remote command as this time is required for the re-charge of a capacitor in the firing circuit which provides the current surge to activate solenoid 50 and discharge the weapon. The arrangement and operation of the firing circuit will be described in relation to FIG. 7.

Referring now to FIG. 7, there is shown a schematic diagram of the energizing and firing circuit which activates the firing means of this invention under remote command of a central control unit. Trigger operating solenoid 50 with solenoid coil 76 is shown in dashed outline. Likewise, switch means 19 is shown in dashed outline.

There are four leads to the circuit terminating at pins 81, 82, 83 and 84 which pins are adapted for connection through connector plug 26 (FIG. 1) and cable 25 to weapon control unit 24. Insertion of plug 26 into its receptacle on the stock 16 of rifle 10 connects pins 81 and 82 together to energize the circuit. Pins 83 and 84 are signal leads.

As may be appreciated by tracing the circuit, connection of pin 81 to pin 82 allows the charging of capacitor 85 by battery 86 through current limiting resistor 87. A second resistor 88 is wired across the terminals of capacitor 85 and thence to ground 89. Resistor 88 allows the charge to bleed off capacitor 85 upon disconnection of the weapon 10 from its control unit 24. In order to accomplish that result, the resistance of resistor 88 is necessarily much greater than is that of resistor 87 so as to allow both rapid charging of capacitor 85 and minimum current draw on battery 86.

When switch 19 is in its normal position, pin 84 is connected to ground 91 through switch contact bar 92 which connects terminals 93 and 94. Because pins 83 and 84 ar signal leads, the grounding of pin 84 by the normally open switch 19 inhibits, or prevents, a "fire" signal from being impressed into the circuit through lead 83. This is a safety feature which prevents firing of the unready weapon through a spurious electrical signal.

Depressing the switch 19 to a activated position moves contact bar 92 from a first position connecting terminals 93 and 94 to a second position connecting terminals 95 and 96. That switch movement, to its closed position, releases pin 84 from ground and provides a ground to the solenoid 50 permitting it to be actuated and fire the weapon. Releasing pin 84 from ground allows an electrical fire signal to be transmitted from the weapon control unit to pin 83 when the control unit receives a fire command. It also permits the weapon control unit to send an "on target" signal.

Another preferred feature of the firing circuit comprises a resistance-capacitance circuit associated with pin 83. This circuit includes resistor 106 and capacitor 107 connected between pin 83 and ground 108. The values of resistor 106 and capacitor 107 are selected such that the circuit has a short time constant, appropriately about 8-10 milliseconds, which prevents triggering of the circuit (with activation of solenoid 50 to fire the weapon) from any transient voltage spike impressed upon the circuit through pin 83. Diodes 111 and 112 prevent reverse current flow to transistor 104 and add noise immunity to signal input 83.

In operation, connecting weapon 10 to its weapon control unit 24 by inserting plug 26 into its receptacle joins pins 81 and 82 which energizes the circuit. That charges capacitor 85 and provides a positive voltage on the emitter of transistor 113. The firing circuit is triggered by impression of a relatively high voltage, on the order of 3 volts, on pin 83 through resistor 103 to transistor 104. This causes transistor 104 to turn on and its collector voltage drops. A drop in the voltage on the collector of transistor 104 causes transistor 113 to turn on by the voltage divider effect of resistors 101 and 103 on the base emitter junction of transistor 113. When transistor 113 saturates, the charge on capacitor 85 is connected through transistor 113 to solenoid 50 and, if switch 19 is in its depressed position, the solenoid 50 is activated causing the weapon to fire. It can be seen that if switch 19 is not depressed, the circuit to the solenoid 50 is not complete and a fire signal cannot fire the weapon.

The foregoing description of the invention and the preferred embodiments thereof are intended to illustrate and explain the invention and various changes and modifications can be made thereto, within the scope of the following claims, without departing from the spirit of the invention.

I claim:

1. Means of firing a weapon by remote command without interfering with the normal firing procedures of said weapon, comprising:

a weapon having a mechanical trigger, said trigger pivoted at a point intermediate its ends and having an arm extending beyound said pivot point, said arm arranged to engage and hold a sear in a cocked position and to release said sear upon movement of said trigger arm;

motive means operating independently of said trigger arranged to move said trigger arm and to release said sear upon receiving a fire command from a source external to said weapon;

signal means independent of trigger movement for causing a ready signal to be continuously transmitted by said external source during those intervals when the weapon is aimed at a designated taraget, said signal means arranged to preclude reception of a fire command by said motive means except during transmission of said ready signal.

2. The means of claim 1 wherein said weapon is a rifle and wherein said motive means comprises a solenoid.

3. The means of claim 2 wherein said solenoid is of the push type having a short stroke plunger.

4. The means of claim 3 wherein the end of said plunger is positioned to rest upon a surface of said trigger arm when said arm is engaging and holding said sear in a cocked position and wherein said plunger stroke moves said trigger arm a sufficient distance to release said sear.

5. The means of claim 2 including switch means arranged to be activated by a rifleman when proper aim is taken on a designated target, the activation of said switch means causing a ready signal to be transmitted by said source.

6. The means of claim 5 wherein said switch means comprises a microswitch on the front trigger surface, said microswitch arranged so that pressure on said microswitch by the finger pressure of said rifleman closes the microswitch without causing trigger movement.

7. The means of claim 5 wherein said switch is a push-to-make switch located on the stock of said rifle near the rifle butt.

8. The means of claim 2 including a solenoid energizing circuit having a power source adapted to charge a capacitor and means adapted to discharge said capacitor through the coil of said solenoid upon reception of a fire signal from said source external to said weapon.

9. The means of claim 8 wherein said means for causing a ready signal to be transmitted by said external source comprises a double-section switch arranged so that one section of said switch is normally open.

10. The means of claim 9 wherein said switch is arranged in said energizing circuit in series with the coil of said solenoid so that an electrical circuit through said solenoid can only be completed when said switch is closed.

11. The means of claim 10 wherein said ready signal is transmitted by said external source only when said switch is closed.

12. The means of claim 11 including a resistance-capacitance sub-circuit within said solenoid energizing circuit having a time constant such that said charged capacitor cannot be discharged by a transient voltage spike impressed upon the circuit.

13. The means of claim 9 wherein said switch is a push-to-make switch located on the stock of said rifle near the butt thereof.

14. The means of claim 8 including a high-resistance pathway adapted to continuously bleed the charge from said capacitor.

* * * * *